US007290871B2

(12) United States Patent
Greer et al.

(10) Patent No.: US 7,290,871 B2
(45) Date of Patent: Nov. 6, 2007

(54) INK CARTRIDGE WITH POCKETED LID

(75) Inventors: David E. Greer, Lexington, KY (US); Christopher W. Pevahouse, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 266 days.

(21) Appl. No.: 10/881,766

(22) Filed: Jun. 30, 2004

(65) Prior Publication Data

US 2006/0001708 A1 Jan. 5, 2006

(51) Int. Cl.
*B41J 2/175* (2006.01)

(52) U.S. Cl. ..... 347/87

(58) Field of Classification Search ..... 347/86, 347/87

See application file for complete search history.

(56) References Cited

U.S. PATENT DOCUMENTS 5,182,581 A * 1/1993 Kashimura et al. ..... 347/87
5,231,416 A 7/1993 Terasawa et al.
5,367,328 A 11/1994 Erickson
5,479,968 A 1/1996 Sanchez et al.
5,495,877 A 3/1996 Schwenk et al.
5,555,007 A * 9/1996 Ceschin et al. ..... 347/87
5,581,287 A 12/1996 Baezner et al.
5,606,353 A * 2/1997 Mochizuki et al. ..... 347/23
5,661,510 A 8/1997 Brandon et al.
6,000,790 A * 12/1999 Takagi et al. ..... 347/87
6,032,010 A 2/2000 Kim et al.
6,097,407 A 8/2000 Terasawa et al.
6,170,937 B1 1/2001 Childers et al.
6,170,941 B1 1/2001 Hara et al.
6,257,711 B1 7/2001 Higuma et al.
6,260,961 B1 7/2001 Seu et al.
6,273,151 B1 8/2001 Kong
6,345,888 B1 2/2002 Matsumoto et al.
6,347,863 B1 * 2/2002 Yuen ..... 347/85
6,386,678 B1 5/2002 Michael et al.
6,390,578 B1 5/2002 Koitabashi et al.
6,390,593 B1 5/2002 DeRoos et al.
6,422,691 B2 7/2002 Kobayashi et al.
6,447,109 B1 9/2002 Williamson et al.
6,454,387 B1 9/2002 Haldorsen
6,454,398 B2 9/2002 Kobayashi et al.
6,478,415 B2 11/2002 Barinaga et al.
6,497,472 B2 12/2002 Sharma et al.
6,520,630 B1 * 2/2003 Oda et al. ..... 347/85
6,530,634 B1 3/2003 Hara
6,550,898 B2 4/2003 Hayashi et al.
6,557,988 B1 5/2003 Hartman
6,575,567 B2 6/2003 Matsumoto et al.
6,578,949 B2 6/2003 Takahashi et al.
6,609,780 B2 8/2003 Sugiyama
6,682,183 B2 1/2004 Jones et al.
6,705,712 B2 3/2004 Usui et al.
6,877,848 B2 * 4/2005 Shimizu et al. ..... 347/86

(Continued)

*Primary Examiner*—Anh T. N. Vo
(74) *Attorney, Agent, or Firm*—Taft, Stettinius & Hollister

(57) ABSTRACT

An ink cartridge having ink reservoirs and foam located in a pocketed lid that fits into a cartridge body. Each pocket has an orifice located such as to deliver ink to as ejection device. The ink reservoirs are filled with ink when the pocketed lid is apart from the cartridge body by injecting the ink into the foam through the orifices in the pockets.

10 Claims, 2 Drawing Sheets

U.S. PATENT DOCUMENTS

2002/0122103 A1 9/2002 Yamamoto et al.
2003/0043240 A1 3/2003 Dowell
2003/0067519 A1 4/2003 Hayashi et al.
2003/0085966 A1 5/2003 Hartman

* cited by examiner

INK CARTRIDGE WITH POCKETED LID

BACKGROUND

This invention relates to an ink cartridge for an ink jet printing apparatus, such as an inkjet printer.

In many ink jet printers, the ink reservoir is contained in a removable ink cartridge, which may also contain the ink delivery components. Such ink cartridges typically consist of an ink reservoir, some form of pressure regulator, an ejector chip, a filter, and ink passages from the ink reservoir to the chip. With thermal inkjet technology, the chip heats the ink and jets it out through a nozzle plate. The pressure regulator keeps the ink entering the chip at a slight negative pressure.

In existing art, the ink reservoirs are often formed by walls or partitions molded into the cartridge body, and pressure regulation is accomplished by inserting a piece of foam into each of the ink reservoirs. The capillary action of the foam creates backpressure for the chip, and the pore size of the foam when compressed determines the ink backpressure.

One aspect of the cartridge design to consider is how it is filled. The standard method to fill a cartridge is to pump the ink through a needle that passes through the lid and is inserted into the foam. The needle extends down through the foam and stops just above the filter. The needle height in this process is critical as it affects the ink saturation around the filter area. It is often difficult to get good saturation when this method is used. If the needle is too close to the filter, some ink is forced through the filter and into the ink channel during ink fill. This wets part of the ink channel and allows air bubbles to remain in the ink channels during prime, preventing a complete prime. If the needle is too high off the filter the ink travels to the top of the foam and begins pooling before the foam around the filter is complete saturated. The pooling ink can contaminate the lid weld surfaces preventing a good weld and also can cause cross contamination between colors.

SUMMARY

In one embodiment, the present invention provides an ink cartridge having an ink reservoir and a pressure-regulating material such as foam located in a pocketed lid that fits with the cartridge body. The pocket has an orifice located such that it can deliver ink to an ejection device. The entire lid, with its integral pocket constituting the ink reservoir, can be secured to the cartridge body, such as by plastic welding or other means, such that the ink reservoir pocket is contained inside the cartridge body.

In one embodiment, the location of the ink reservoirs and pressure-regulating material in open-bottom pockets in the lid can, for example, allow the foam to be filled with ink from the bottom through the same orifices through which ink flows during normal printing operations. The filling can be performed when the lid is separated from the cartridge body, thus allowing optimal saturation of the foam without wetting the filters and ink channels.

Accordingly, it is one aspect of the present invention to provide an ink cartridge for an ink jet printing apparatus that includes: a cartridge body having external walls, an open portion, and at least one outlet through which ink may pass to feed ink to an ejection device; and a lid covering the open portion of the cartridge body, where the lid has at least one ink reservoir pocket extending into the cartridge body, and where the pocket has an orifice in fluid communication with the outlet of the cartridge body. In a more detailed embodiment, the ink cartridge can include an ink filter in fluid communication with the orifice of the pocket. In an even more detailed embodiment, the ink filter can be attached to the cartridge body. In an even more detailed embodiment, the ink filter can be made of stainless steel mesh.

In an alternate detailed embodiment of the aforementioned aspect of the present invention, the ink cartridge can include a pressure-regulating material such as a foam material residing in the pocket, where the pressure-regulating material at least partially fills the volume of the pocket and is in fluid communication with the orifice of the pocket.

In an alternate detailed embodiment of the aforementioned aspect of the present invention, the cartridge body includes a plurality of outlets through which ink may pass to an ejection device, and the lid includes a corresponding plurality of the pockets, where each pocket has an orifice in fluid communication with a respective cartridge outlet. This embodiment may be practiced in such a way that each of the plurality of pockets contains a different color of ink. Additionally, this embodiment may further be practiced in the same more detailed embodiments as stated above for the aforementioned aspect of the present invention and its alternate embodiments.

It is another aspect of the present invention to provide a pocketed lid for an ink cartridge, where the pocketed lid includes at least one ink reservoir pocket extending into a cartridge body, and where the pocket has an orifice in fluid communication with an outlet of the cartridge body.

It is a further aspect of the present invention to provide a method for filling an ink cartridge with ink. The method might include the following steps: (a) providing a pocketed lid for a cartridge body, where the pocketed lid has at least one ink reservoir pocket; (b) flowing ink into the pocket of the pocketed lid; and (c) mounting the pocketed lid with a cartridge body. In a detailed embodiment, the ink can flow into the pocket of the pocketed lid from the bottom of the pocket. In a further detailed embodiment, the ink can flow into the pocket of the pocketed lid through the same orifice through which ink flows out of the pocket during normal printing operations. In yet a further detailed embodiment, the method might further include, prior to (b) flowing ink into the pocket of the pocketed lid, the step of (a1) placing the pocketed lid onto an ink fill fixture, where the ink fill fixture has an ink fill nozzle in fluid communication with the pocket in the pocketed lid.

In an alternate embodiment, the pocketed lid might include a plurality of ink reservoir pockets. In a more detailed embodiment, the ink flows into each of the plurality of pockets of the pocketed lid through the same orifices through which ink flows out of the respective pocket during normal printing operations. In yet a further detailed embodiment, the method might further include, prior to (b) flowing ink into the pocket of the pocketed lid, the step of (a1) placing the pocketed lid onto an ink fill fixture, where the ink fill fixture has an ink fill nozzle in fluid communication with each of the plurality of pockets in the pocketed lid.

It is a yet another aspect of the present invention to provide an ink cartridge for an ink jet printer that includes: a cartridge base having at least one outlet through which ink may pass to feed ink to an ejection device; and a cartridge cover for coupling to the cartridge base, the cartridge cover providing a wall of the ink cartridge and including at least one ink reservoir pocket extending from the wall toward the cartridge base, the pocket having an orifice in fluid communication with the outlet of the cartridge body. In a more detailed embodiment, the outer walls of the ink cartridge are provided by cartridge base and/or the cartridge cover. In a yet a further detailed embodiment, the ink cartridge includes an ink filter in fluid communication with the orifice of the pocket. In an even more detailed embodiment, the ink filter is attached to the cartridge base.

DETAILED DESCRIPTION

Figure 1:
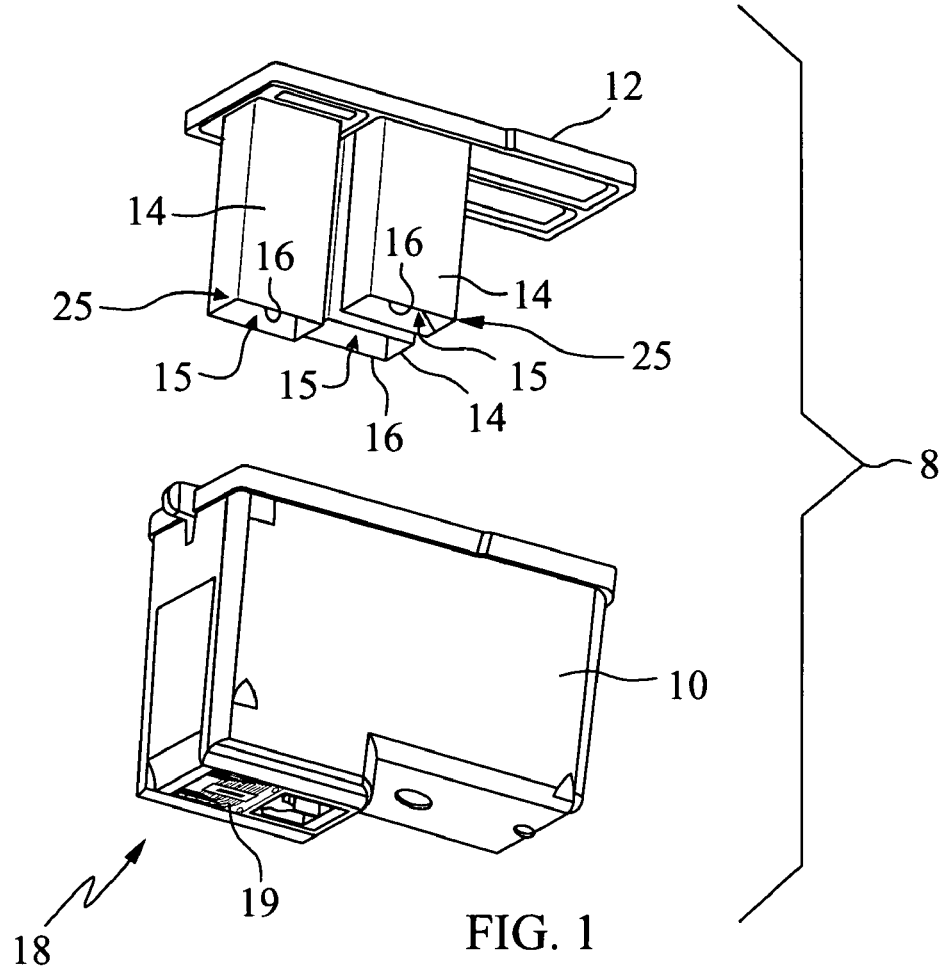
FIG. 1 is an exploded perspective view of an exemplary embodiment of the present invention providing a lid containing three ink-pockets along with a standard cartridge body.
Figure 2:
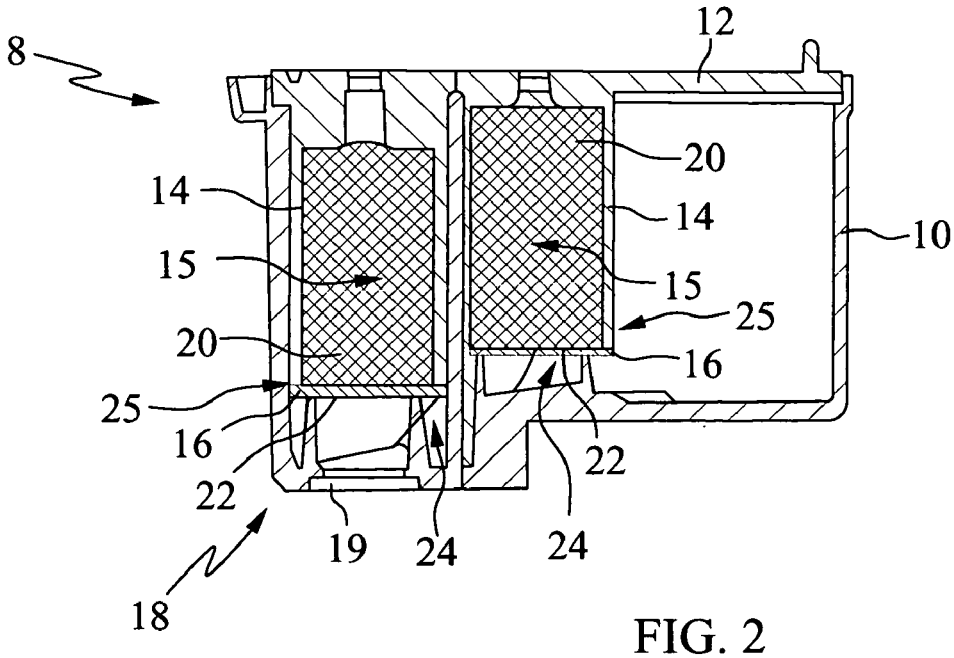
FIG. 2 is an elevational cross section view of the assembled exemplary embodiment.

As shown in FIGS. 1 and 2, an ink cartridge 8 according to an exemplary embodiment of the present invention includes a cartridge body 10 and a "pocketed lid" 12. The "pocketed lid" 12 can feature one or more "pockets" 14 (also referred to as sub-chambers) that extend from the lid into the cartridge body 10. These pockets 14 serve as ink reservoirs 15. Each pocket 14 has an orifice 16 located such that it can deliver ink to an ejection device, such as a heater chip 19, that may be on the cartridge body (or in fluid communication therewith). The entire lid 12, with its integral pockets constituting the ink reservoirs, is secured to the cartridge body 10, such as by plastic welding or other means, such that the ink reservoir pockets 14 are contained inside the cartridge body 10.

It is a feature of this exemplary embodiment that the cartridge body remains unchanged from existing cartridge bodies, and all the changes are contained in the lid. This is advantageous because the tooling for the body is very complex, making modifications or retooling quite expensive. Also, the body goes through many assembly steps in the manufacturing process, each being potentially negatively impacted if the body were modified. The lid, on the other hand, is a simple mold and easily changed or retooled. The attachment of the lid is also one of the last assembly steps in the manufacturing process of a cartridge, and impact on the manufacturing process is minimized by confining all changes to the lid.

Referring specifically to FIG. 2, the pocketed lid 12, which contains the ink reservoirs 15, is seated on the cartridge body 10. The pockets 14 are visible extending downward toward the bottom of the cartridge. Each pocket is filled with a pressure-regulating material, such as a foam material 20. The pressure-regulating material creates an ink backpressure at the orifice 16 by capillary action, and the pore size of the material when compressed determines the ink backpressure. The pockets and foam size are of optimum volume for the desired quantity of ink to be filled into the cartridge. At the bottom of each pocket 14, the foam 20 is in fluidic contact with an ink filter 22 that is mounted inside the cartridge body 10. The foam is stuffed into the pockets leaving some foam slightly protruding from the orifice 16 at the bottom of the pocket. When the pocketed lid 12 is welded to the cartridge body 10, the foam is forced down against the stainless steel mesh ink filters 22, providing a good fluidic connection. This allows ink to flow from the ink reservoir pocket 14, through the ink filter 22, and into the ink channels 24. From the ink channels 24, the ink is delivered to the heater chip 19 at the bottom of the cartridge.

A new method can be used to fill the ink reservoirs of such an exemplary embodiment, and this method eliminates difficulties present with existing ink-fill methods. In the exemplary embodiment, the foam 20 is placed into pockets in the lid. These pockets 14 are open at their bottom ends 25 providing the orifice 16, which allows them to be filled with ink through this orifice 16 prior to installation of the pocketed lid 12 into the cartridge body 10. After the foam 20 is inserted into the pockets 14 in the lid 12, the lid is placed onto an ink fill fixture 30 provided in FIG. 3 and clamped thereto.

Figure 3:
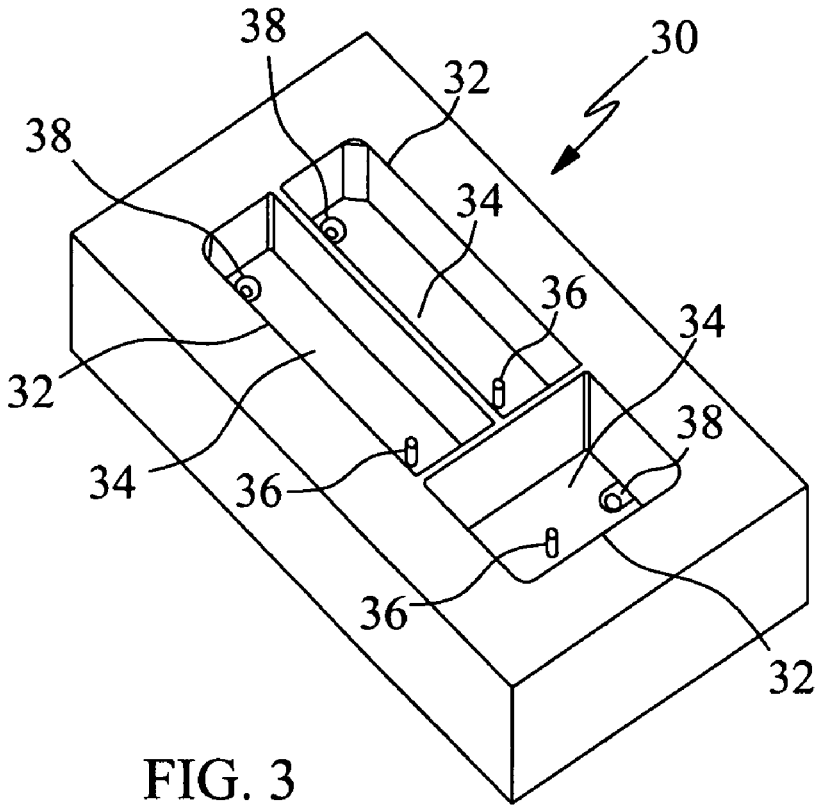
FIG. 3 is an exemplary embodiment of an ink fill fixture that may be used to fill the ink reservoir pockets in the exemplary embodiment of pocketed lid.

As shown in FIG. 3, this ink fill fixture 30, has one or more receptacles 32, one for each pocket 14 in the pocketed lid 12. Each receptacle 32 has a gasket sheet 34 covering the bottom to seal against the open end 16 of the lid pocket 14. Each receptacle 32 also includes an ink fill nozzle 36 extending therein to inject the ink into the foam 20 in the pocket 14. The use of separate receptacles 32 prevents cross contamination between the different ink colors. Each receptacle 32 also has a drain hole 38 to dispose of any ink that leaks past the gasket sheet 34 during the filling process.

During the ink fill process, the ink is pumped into the foam 20 though the ink fill nozzles 36 into the lid pockets 14 from the bottom, through the open end 16 of the pockets. This gives the optimal ink fill, one that is full saturated at the bottom (the end that will be against the filter) and does so without pre-wetting the filter and ink channels, which are located in the cartridge body 10. After the foam 20 is filled with ink, the pocketed lid 12 is removed from the ink fill fixture 30 and mated to the cartridge body 10. The pocketed lid 12 is then welded in place and the completed cartridge assembly is then primed in the conventional manner. Because the foam 20 was filled with ink when separated from the cartridge body 10, the ink channels 24 are dry prior to prime, which gives a much more consistent and complete prime, one that removes most all air from the channels. This improved prime increases first time functional test rates compared with the existing ink fill methods.

Figure 4:
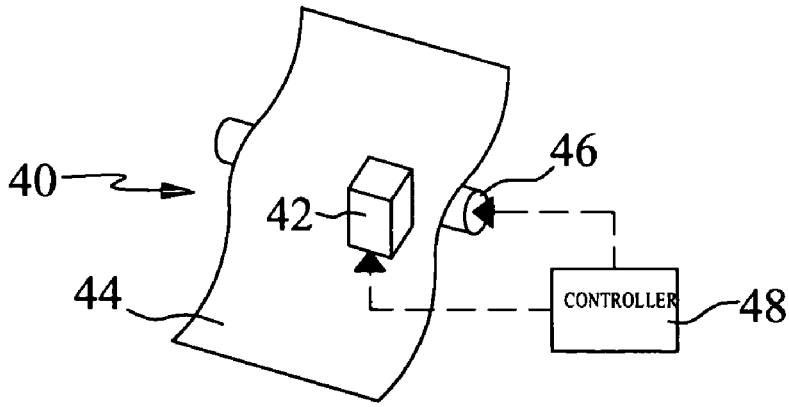
FIG. 4 is a schematic representation of an ink jet printer incorporating the exemplary embodiment of the present invention.

As shown in FIG. 4, an ink jet printer 40 utilizing embodiments of the present invention contains a print carriage 42 that carries the print heads, the print cartridge described above, and related apparatus for applying ink to the print medium or page 44. The page 44 is driven through the printer past the print carriage 42 by associated drive mechanisms 46. The coordinated operations of the print carriage 42 and drive mechanism 46 are controlled by one or more controllers 48 as will be appreciated by those of ordinary skill in the art.

Having described the invention with reference to the exemplary embodiment, it is to be understood that the invention is defined by the claims and it not intended that any limitations or elements describing the exemplary embodiment set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

For example, and without limitation, it is not necessary that the cartridge body 10 be an existing cartridge, where all the changes are contained in the lid. It is therefore, within the scope of the invention that an ink cartridge includes: a cartridge base having at least one outlet through which ink may pass to feed ink to an ejection device; and a cartridge cover for coupling to the cartridge base, where the cartridge cover provides a wall of the ink cartridge and includes at least one ink reservoir pocket extending from the wall toward the cartridge base, and where the pocket has an orifice in fluid communication with the outlet of the cartridge body. In such an embodiment the outer walls of the ink cartridge may be provided by cartridge base and/or the cartridge cover.

What is claimed is:

1. An ink cartridge, comprising:

a cartridge body having external walls with interior surfaces, an open portion, and at least one outlet through which ink may pass to feed ink to an ejection device;

a lid covering the open portion of the cartridge body, the lid having at least one ink reservoir pocket extending into the cartridge body, the pocket having an orifice in fluid communication with the outlet of the cartridge body and the pocket extending downwardly adjacent to the external walls for substantially the entire height of the external walls between the open portion and the outlet of the cartridge body;

a pressure-regulating material residing in the pocket, wherein the pressure-regulating material at least partially fills the volume of the pocket and is in fluid communication with the orifice of the pocket; and an ink filter in fluid communication with the orifice of the pocket;

wherein the ink filter is in contact with the pressure-regulating material protruding from the orifice of the pocket.

2. A pocketed lid for an ink cartridge, comprising:

a wall;

at least one ink reservoir pocket extending from the wail, the ink reservoir pocket having an orifice approximate an end thereof adapted to provide fluid communication between an interior of the ink reservoir pocket and an ejection device associated with a cartridge to which the wall is adapted to be mounted; and a pressure-regulating material residing in the pocket wherein the pressure-regulating material at least partially fills the volume of the pocket, the pressure-regulating material is in fluid communication with the orifice of the pocket and the pressure-regulating material contains ink;

wherein the cartridge includes external walls having interior surfaces and at least one outlet through which ink may pass to feed ink to the ejection device; and wherein the pocket extends adjacent to the interior surfaces of the external walls of the cartridge for substantially the entire length of the external walls of the cartridge between the wall and the outlet of the cartridge.

3. The pocketed lid of claim 2, further comprising a plurality of the ink reservoir pockets extending from the wall, each of the plurality of ink reservoir pockets having an orifice approximate an end thereof adapted to provide fluid communication between a respective interior of the ink reservoir pockets and the ejection device.

4. An ink cartridge, comprising:

a cartridge base having at least one outlet through which ink may pass to feed ink to an ejection device;

a cartridge cover for coupling to the cartridge base, the cartridge cover providing a wall of the ink cartridge and including at least one ink reservoir pocket extending from the wall toward the cartridge base for substantially the entire height of the cartridge base between the wall and the outlet of the cartridge base, and the pocket having an orifice in fluid communication with the outlet of the cartridge base; and a pressure-regulating material residing in the pocket, wherein the pressure-regulating material at least partially fills the volume of the pocket the pressure-regulating material is in fluid communication with the orifice of the pocket, and the pressure-regulating material is substantially filled with ink.

5. The ink cartridge of claim 4, wherein outer walls of the ink cartridge are provided by at least one of the cartridge base and the cartridge cover.

6. The ink cartridge of claim 4, further comprising an ink filter in fluid communication with the orifice of the pocket.

7. The ink cartridge of claim 6, wherein the ink filter is provided on the cartridge base.

8. The ink cartridge of claim 4, wherein the cartridge cover includes a plurality of the ink reservoir pockets extending from flue wall toward the cartridge base, each of the plurality of pockets having an orifice in fluid communication with a respective outlet of the cartridge body.

9. An ink cartridge comprising:

a cartridge body including external side walls having interior surfaces, an open top portion, a floor, and at least one outlet in the floor through which ink may pass to feed ink to an ejection device; and a lid covering the open top portion of the cartridge body and including at least one ink reservoir pocket extending into the cartridge body, the ink reservoir pocket having an outlet orifice operatively coupled to and in fluid communication with the outlet of the cartridge body and having pocket walls, the pocket walls extending downwardly adjacent to the interior surfaces of the external side walls of the cartridge body and defining an interior volume;

wherein the ink reservoir pocket contains ink within the interior volume defined by the pocket walls for passing through the outlet orifice to the outlet of the cartridge body.

10. The ink cartridge of claim 9, wherein the pocket walls extend downwardly adjacent to the interior surfaces of the external walls for substantially the entire height of the external wall between the open portion and the outlet of the cartridge body.

* * * * *